US010624441B1

(12) United States Patent
Sullivan

(10) Patent No.: US 10,624,441 B1
(45) Date of Patent: Apr. 21, 2020

(54) MAGNETIC PENCIL HOLDER FOR A WRITING IMPLEMENT

(71) Applicant: Jeffrey Allen Sullivan, Seffner, FL (US)

(72) Inventor: Jeffrey Allen Sullivan, Seffner, FL (US)

(73) Assignee: Axis Construction Inc., Seffner, FL (US)

( * ) Notice: Subject to any disclaimer, the term of this patent is extended or adjusted under 35 U.S.C. 154(b) by 0 days.

(21) Appl. No.: 16/533,434

(22) Filed: Aug. 6, 2019

(51) Int. Cl.
*B43K 23/00* (2006.01)
*B43K 25/00* (2006.01)
*A45F 5/02* (2006.01)

(52) U.S. Cl.
CPC ..... *A45F 5/02* (2013.01); *B43K 23/001* (2013.01); *B43K 25/00* (2013.01); *A45F 2200/0566* (2013.01)

(58) Field of Classification Search
CPC . A45F 5/02; A45F 2200/0566; B43K 23/001; B43K 23/002; B43K 25/00; Y10T 24/1321
USPC ..... 224/183, 251; D3/206
See application file for complete search history.

(56) References Cited

U.S. PATENT DOCUMENTS 2,594,955 A 4/1952 Markowitz
2,644,212 A * 7/1953 Markowitz ..... B43K 23/001 24/11 R
3,159,372 A 12/1964 McIntosh
3,387,341 A * 6/1968 Mates ..... A44B 18/00 24/306
D441,021 S * 4/2001 Roush ..... D19/135
D499,764 S * 12/2004 Arnold ..... D19/84
8,235,262 B1 8/2012 Sakdol
9,409,437 B2 * 8/2016 Green ..... B43K 29/02
9,969,208 B1 * 5/2018 Hall ..... B43M 99/006
10,202,994 B2 * 2/2019 Andrus ..... A45F 5/02
10,328,742 B2 * 6/2019 Green ..... B43K 29/02
10,421,311 B2 * 9/2019 Mullen ..... B43K 23/001
2003/0145500 A1 * 8/2003 Lykens ..... G09F 7/04 40/661.01
2005/0223525 A1 * 10/2005 Wartian ..... A42B 1/24 24/3.12
2008/0054033 A1 3/2008 Synness
2010/0219217 A1 * 9/2010 Andochick ..... A45F 5/02 224/250

(Continued)

*Primary Examiner* — Justin M Larson
(74) *Attorney, Agent, or Firm* — Smith & Hopen, P.A.; Steven M. Forte; Paul Murty

(57) ABSTRACT

A holder for securing a writing implement to a magnetic surface. The holder includes a body that extends between a first end and a second end of the housing. The body includes a plurality of lateral interior surfaces. A first and second ends of the body defining an opening that has a channel extending between the lateral interior surfaces from the first end to the second end. A protrusion is disposed within the housing and extends from one lateral interior surface toward the channel. A stopper is disposed proximate to the second end of the body and partially extends from a lateral interior surface toward the second opening. A magnet is located within the housing and rests against one of the lateral interior surfaces and the stopper preventing movement of the magnet. The housing receives the writing implement and a protrusion contacts the writing implement securing it in place.

20 Claims, 5 Drawing Sheets

(56) References Cited

U.S. PATENT DOCUMENTS

| | | | | |
|---|---|---|---|---|
| 2014/0331388 | A1* | 11/2014 | Nunan | A45F 5/02 2/244 |
| 2016/0023500 | A1* | 1/2016 | Wang | B43K 23/04 401/131 |

* cited by examiner

MAGNETIC PENCIL HOLDER FOR A WRITING IMPLEMENT

BACKGROUND OF THE INVENTION

1. Field of the Invention

This invention relates, generally, to pencil holders. More specifically, it relates to magnetic pencil holders for carpenter pencils.

2. Brief Description of the Prior Art

Carpenter pencils are widely used by carpenters, construction workers, and amateur laborers/builders who need to mark-up or write on rougher surfaces, particularly surfaces on which a typical soft leaded pencil cannot easily make marks. A carpenter pencil's unique shape is derived from need and functionality. The carpenter pencil includes a body that has a rectangular or elliptical cross-section to prevent the pencil from rolling away on the job site. However, carpenter pencils are routinely misplaced while working on the job site and many builders resort to sticking them behind their ears, on tool belts, or in toolboxes to prevent them from being lost in the commotion of a busy job site. While a carpenter pencil may be temporarily stored behind the ear, only a small amount of force is required to displace the pencil and knock it free, resulting in a lost pencil somewhere on the site. However, placing the pencil in a tool belt or toolbox is no better, because the heavy weight of tools stored in such containers, such as sold metal wrenches or heavy power tools, can cause the stored pencils to break.

Prior art U.S. Pat. No. 8,235,262 B1, issued Aug. 7, 2012, to Sakdol illustrates a holder for securing a writing implement to a work article. The holder includes a clamp portion having two ends adapted to engage the two slots of the upper surface of the base, an elastomeric band securing the clamp portion to the slots of the upper surface of the base that retains the writing implement. However, the holder taught by the Sakdol reference has significant drawbacks. For example, the base and the clamp portion are two separate pieces that come together to form the holder and must be secured together via an elastic band. Providing separate pieces increases the chance that one or more pieces of the holder will be misplaced or lost, rendering the holder ineffective. Additionally, in order to secure the writing implement within the housing, the user must go through a complicated assembly process.

A magnetic holder for pencils is discussed in U.S. Pat. No. 3,159,372 ('372 Patent), issued Jan. 5, 1961 to McIntosh illustrates a magnetic pencil holder having outwardly flaring wings which have inwardly turned upper ends, with an opening between the wings, such that the wings are discontinuous with each other. The flaring wing design has significant drawbacks as the pencil residing within the wings is inherently less secure than the present invention. The pencil in the '372 Patent is more prone to being knocked out of the outwardly flaring wings and subsequently lost, since a portion of the pencil of the '372 Patent is left exposed and unsecured within the holder. This issue is solved within the present invention because the writing implement is secured and surrounded on all sides by the pencil holder. The writing implement may only be removed from the pencil if pushed or pulled with a force greater than the frictional force securing it within the pencil holder.

Accordingly, what is needed is a magnetic pencil holder that can attach to any magnetic surface or utilize a complementary magnet that allows a user to quickly, safely, and easily keep track of and store carpenter pencils when not in use. However, in view of the art considered as a whole at the time the present invention was made, it was not obvious to those of ordinary skill in the field of this invention how the shortcomings of the prior art could be overcome.

All referenced publications are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for a magnetic pencil holder having a body with protrusions used to secure a carpenter pencil within a housing that allows for quick, safe, and easy access is now met by a new, useful, and nonobvious invention.

The novel structure includes a housing having a body that includes a plurality of lateral interior surfaces. The body extends between a first end and a second end with each end defining an opening. A channel extends between a plurality of lateral interior surfaces from the first end to the second end. A protrusion is disposed within the housing and extends from one of the lateral interior surfaces toward the channel. The protrusion extends along the entire length of one of the lateral interior surfaces. In an embodiment, there are two protrusions that extend along one of the lateral interior surfaces. When the writing implement is received within the housing the protrusions contacts the writing implement which secures the writing implement in place through friction fitting.

A stopper is disposed at the proximate end of the second end of the body partially extending from one of the lateral interior surfaces of the body toward a central longitudinal axis of the second opening. A magnet is positioned within the housing and rests against one of the lateral interior surfaces and the stopper. The stopper prevents a longitudinal movement of the magnet through the second end of the body. In an embodiment, the magnet is placed within a first and a second slot. The first slot is formed adjacent to one of the lateral interior surfaces, the slot being sized to receive and secure the magnet. The magnet abuts the stopper preventing movement of the magnet within the housing.

In an embodiment, the lateral interior surfaces have a top opposite a bottom and a first side that is opposite a second side. A slot is formed between the first side and the bottom and received the magnet. In an embodiment, the slot is formed adjacent to one of the of lateral interior surfaces sized to receive and secure a magnet of various geometries. In an embodiment, the lateral interior surfaces further include a first side that is opposite a second side. The first and second sides each have an extension that extends inwardly toward the channel and contacts the writing implement when received within the housing.

In an embodiment, the magnetic pencil holder has a complementary magnet that is attracted to the magnet of the pencil holder. This allows a user to wear the magnetic pencil holder on an article of clothing for quick and easy access. In an embodiment, the magnet is placed around the outer surface of the body.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

In the following detailed description of the preferred embodiment, reference is made to the accompanying drawings, which form a part thereof, and within which specific embodiments are shown by way of illustration by which the invention may be practiced. It is to be understood the other embodiments may be utilized and structural changes may be made without departing from the scope of the invention.

Figure 1A:
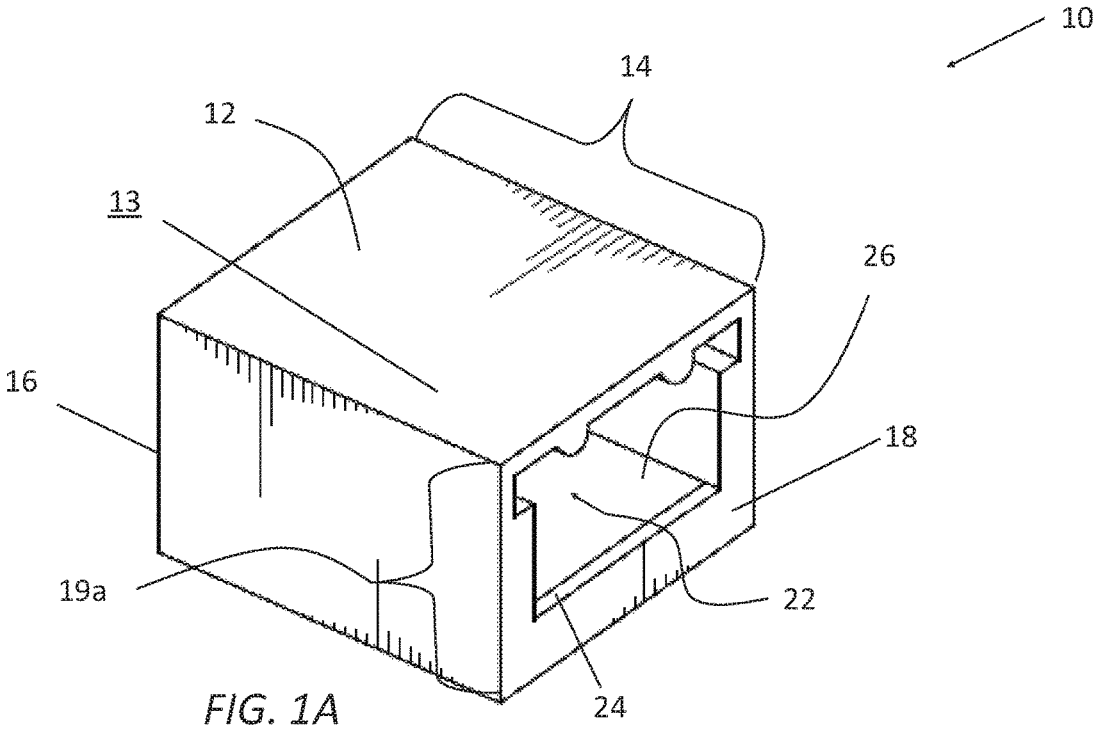
FIG. 1A is a perspective view of an embodiment of the pencil holder showing the second end.
Figure 1B:
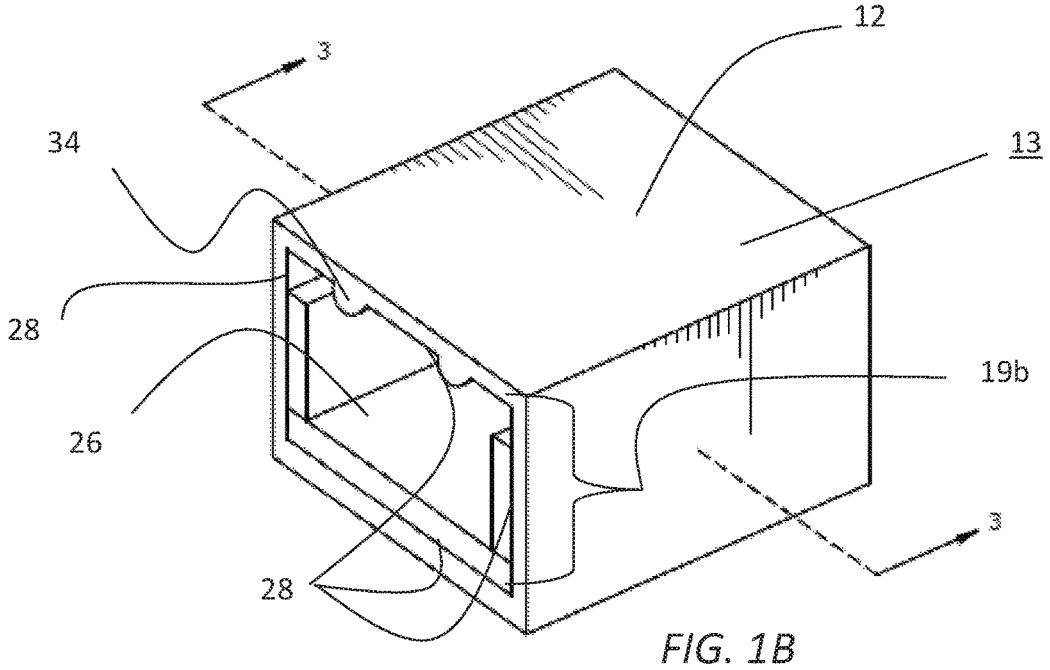
FIG. 1B is a perspective view of an embodiment of the pencil holder showing the first end.
Figure 1C:
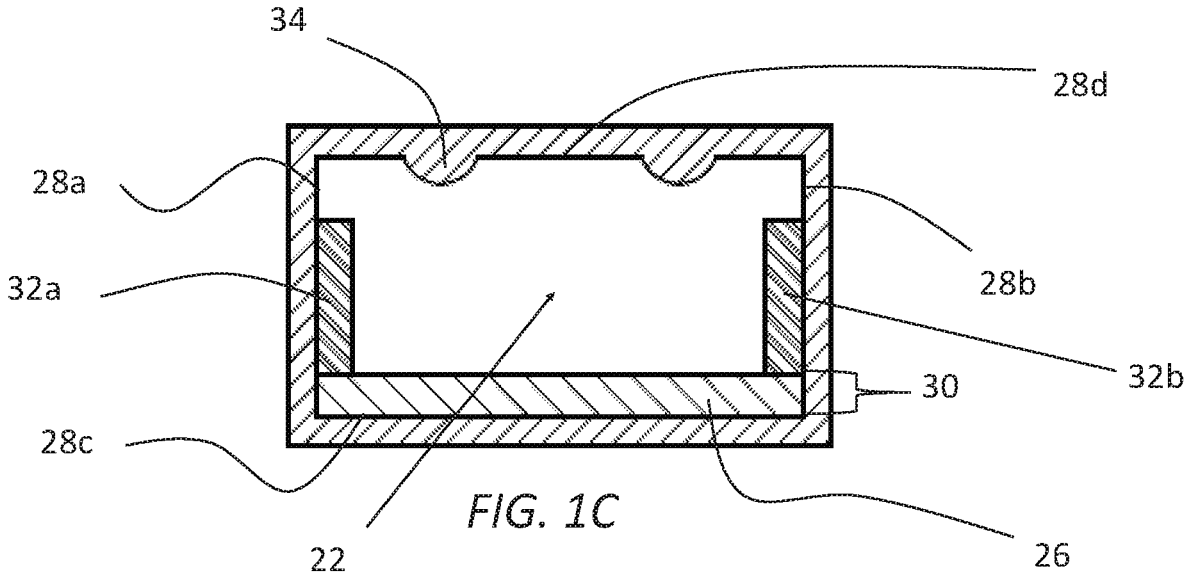
FIG. 1C is a frontal view of an embodiment of the pencil holder.

FIGS. 1A-C depict a magnetic pencil holder 10. Pencil holder 10 includes housing 12 with body 14 extending between first end 16 and second end 18, each end defining an opening 19*a* and 19*b*. Body 14 includes two sets of lateral interior surfaces 28 in an orthogonal relationship with one another. The first set includes first side 28*a* opposite second side 28*b* and the second set includes third side 28*c* opposite fourth side 28*d*. In an embodiment, body 14 has a length of about 10 mm to 25 mm, a height of about 10 to 15 mm and a width of about 10 mm to 25 mm. Each of the lateral interior surfaces may have a width of about 1 mm to 2 mm. Channel 22 extends between each lateral interior surface 28 from first end 16 to second end 18, enabling writing implement 5 to be disposed through channel 22. Lateral interior surfaces 28 can be arranged in any configuration, shape, and/or size to accommodate the geometry of writing implement 5. In an embodiment, writing implement 5 is a carpenter pencil. Carpenter pencils typically have a body with a rectangular or elliptical cross-section to prevent the pencils from rolling away. For example, a carpenter pencil may have a width of about 13.76 mm and a height of 7.56 mm.

Body 12 further includes outer surface 13 that is configured to receive a measuring indicium which displays imperial and/or metric measuring units. In an embodiment, other reference and measuring devices may be integrated with pencil holder 10, such as a laser, a level, a protractor, or other measuring and reference tools that one of ordinary skill in the art would appreciate. Stopper 24 is disposed at the of second end 18 of body 14 and partially extends from one of the lateral interior surfaces 28 toward a central longitudinal axis of second opening 18. In an embodiment, stopper 24 may be disposed at the proximate end of the first end 16 of body 14. Stopper 24 may be continuous with one or more lateral interior surfaces 28. In an embodiment, stopper 24 may be a separate or removable component from that of housing 14. In an embodiment, pencil holder 10 may be constructed of acrylonitrile-butadiene-styrene (ABS), metal, a magnetic compound, ceramic, rubber, an elastomeric material, or any other material that one of ordinary skill in the art would appreciate providing structure and support to pencil holder 10.

As shown in FIGS. 1A-C, in an embodiment of the pencil holder 10, protrusions 34 have a length equal to the length of lateral interior surface 28*d*. Protrusions 34 may be disposed within housing 14 and may extend from lateral interior surface 28*d* toward channel 22. For example, protrusions 34 extend from lateral interior surface 28*d* to channel 22 about 0.5 mm to 1.5 mm. Housing 12 is configured to receive writing implement 5, such that protrusions 34 contact writing implement 5 when received within housing 12. In an embodiment, protrusions 34 exert a securing-type force on writing implement 5 securing the implement within pencil holder 10 preventing the lateral and/or horizontal movement of writing implement 5 within channel 22. In an embodiment, a single protrusion 34 may be implemented while other embodiments have a plurality of protrusions 34. In certain embodiments, protrusions 34 may extend the entire length of lateral interior surface 28 or a portion thereof. Moreover, protrusions 34 may be placed randomly or in an ordered configuration. While protrusions 34 are shown in FIGS. 1A-1C as extending toward channel 22 from lateral interior surface 28*d*, it is appreciated that protrusions 34 may extend toward channel 22 from one or more lateral interior surfaces 28.

Further referring to FIGS. 1A-C, slot 30 is formed adjacent to one of the lateral interior surfaces 28 and is configured to receive and secure magnet 26. First side 28*a* and second side 28*b* have extensions 32*a* and 32*b* respectively, extending inwardly toward channel 22 and contacting writing implement 5 when writing implement 5 is received within housing 12. Extensions 32*a* and 32*b* may extend in parallel relation to first side 28*a* and second side 28*b* and in an orthogonal relationship with third side 28*c* and fourth side 28*d*. Extensions 32*a* and 32*b* may extend toward and abut fourth side 28*d*. Extensions 32*a* and 32*b* may extend toward third side 28*c* such that the distance that extensions 32*a* and 32*b* extend toward third side 28*c* dictates the height of magnet 26. As such, slot 30 may be formed between a least a portion of each extensions 32*a* and 32*b* and third side 28*c*, with magnet 26 being insertable within slot 30.

Magnet 26 is positioned within housing 12 and rests against at least a portion of each first side 28*a*, second side 28*b*, and third side 28*c* of lateral interior surfaces 28 and stopper 24. In an embodiment, magnet 26 may be disposed on outer surface 13 of body 12. Body 12 may be at least partially formed of a magnetic material, such that body 12 and magnet 26 are the same component. In an embodiment, magnet 26 may be formed of neodymium iron boron, samarium cobalt, alnico, ferrite, or any other object known in the art to produce a magnetic field. In an embodiment, magnet 26 may be any mineral, element, or material that is at least partially formed from at least one ferromagnetic material and has magnetic properties. In an embodiment, magnet 26 has a gauss value between 50 and 1500 gauss, such that magnet 26 is not easily knocked off the surface it is magnetically secured to while not being magnet 26 so strong that a human would be unable to decouple magnet 26 from the surface it is magnetically coupled with. In an embodiment, magnet is about 17 mm by 17 mm by 1.6 mm.

Stopper 24 prevents the longitudinal movement of magnet 26 through second end 18 of body 14. In an embodiment, extensions 32*a* and 32*b* extend inwardly toward channel 22 about 0.5 mm to 1.5 mm in width. In an embodiment, extensions 32*a* and 32*b* have a height of about 1 mm to about 8 mm. Extensions 32*a* and 32*b* prevent the lateral movement of magnet 26 within channel 22. In an embodiment, slot 30 is substantially the same shape and size as magnet 26. It is undesirable for slot 30 to be large enough to where magnet 26 is unable to be secured within slot 30, such that when pencil holder 10 is used magnet 26 fall out. In an embodiment, slot 30 may be smaller than magnet 26 forming a press fit, securing magnet 26 within slot 30. In an embodiment, slot 30 is about 1.0 mm to 2 mm in height. In an embodiment, body 12 of pencil holder 10 is flexible to allow magnet 26 with fit within slot 30 and form a press fit.

Figure 2:
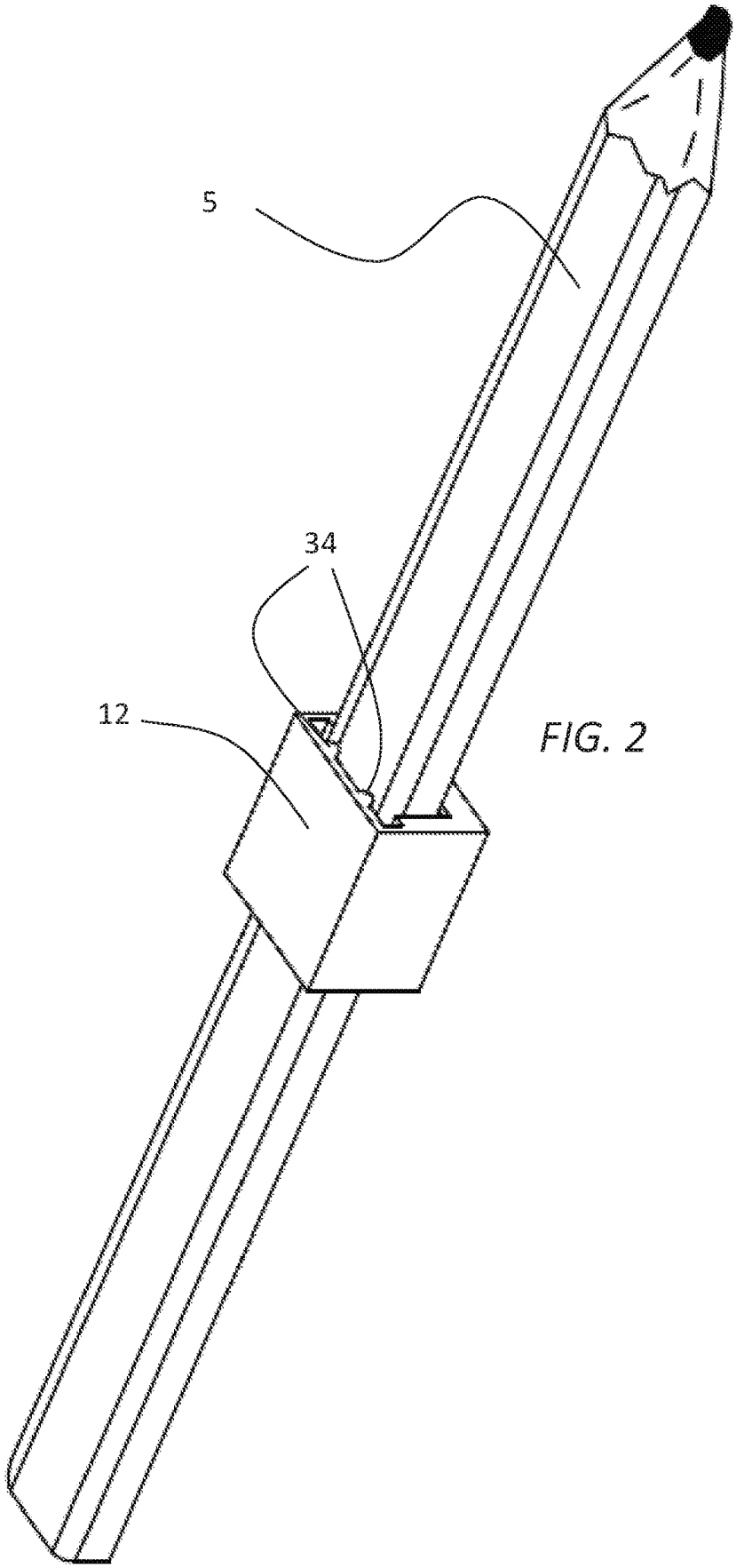
FIG. 2 is a view of an embodiment showing the pencil holder secured with a complementary magnet to an article of clothing.

FIG. 2 depicts an in-use view of pencil holder 10 having writing implement 5 disposed within housing 12 and interference fitted by protrusions 34. Writing implement 5 is at least partially disposed within housing 5 by pushing or pulling writing implement 5 within channel 22 of housing 12. When writing implement 5 is disposed within housing 12 at least one protrusion 34 contacts a surface of the writing implement 5 securing it within housing 12. In an embodiment, each of the lateral interior surfaces 28 at least partially contacts a surface of writing implement 5. When writing implement 5 is secured within housing 12, a user can use writing implement 5 without substantial interference from housing 12, whereby substantial interference causes the user to remove pencil holder 10 from writing implement 5 before use.

Figure 3A:
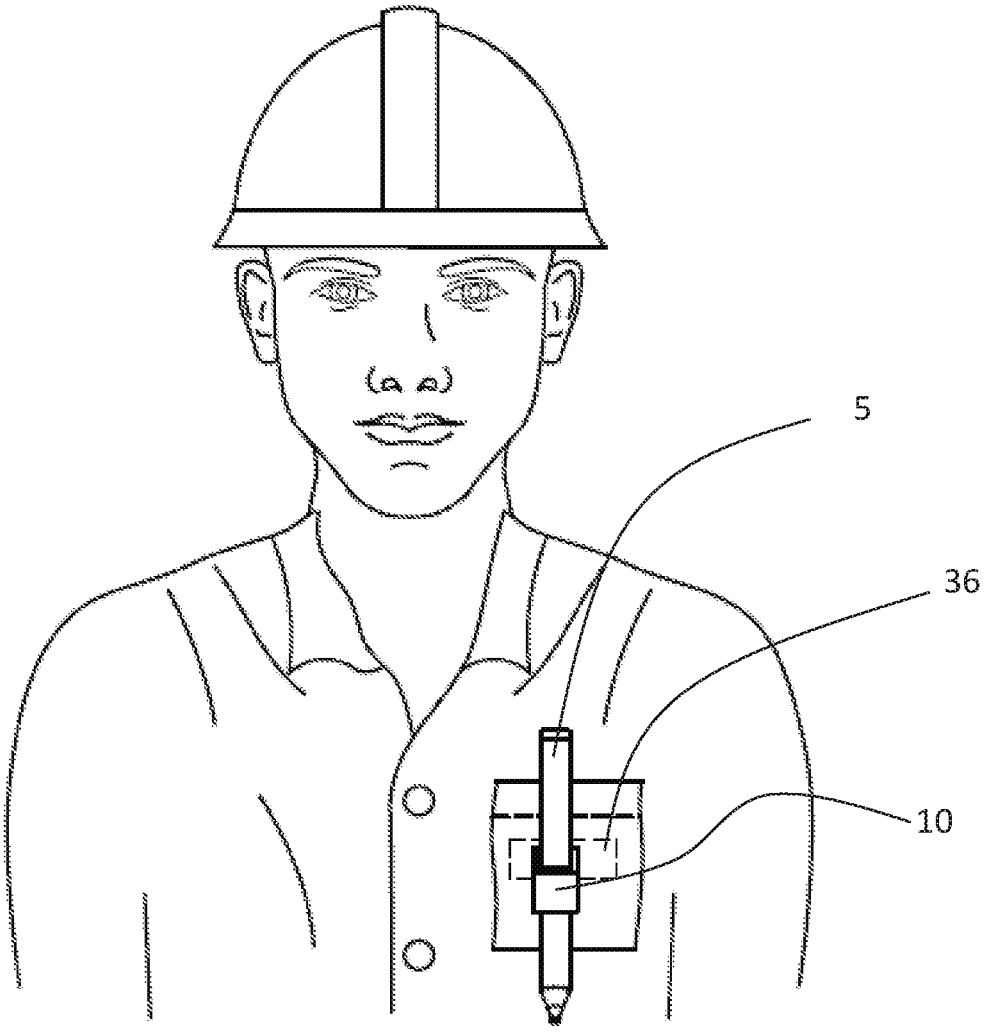
FIG. 3A is an in-use view of an embodiment of the invention having a writing implement disposed within the pencil holder.

FIG. 3A depicts an in-use view of pencil holder 10 secured to an article of clothing. Complementary magnet 36 and magnet 26 are magnetically attracted to one another. A user can place an article of clothing between complimentary magnet 36 and magnet 26, such that the two magnets are in magnetic communication with one another, preventing pencil holder 10 from detaching from complimentary magnet 36 or otherwise being misplaced. When it is time for the user to use pencil holder 10 or writing implement 5 disposed within housing 12, the user can simply pull pencil holder 10 away from complimentary magnet 36 so that the two magnets are no longer in magnetic communication with one another. To re-secure pencil holder 10, the user brings magnet 26 that is disposed within housing 12 in close proximity to complementary magnet 36 such that they are in magnetic communication with one another again, securing the pencil holder to an article of clothing. In an embodiment, housing 12 may include a fastening means, such as a clip for clipping the pencil holder to an article of clothing. In an embodiment, the fastening means is a safety pin, hook and loop, adhesive, pin, one or more magnets, or any other means that one of ordinary skill in the art would appreciate to removably couple pencil holder 10 to an article of clothing.

Figure 3B:
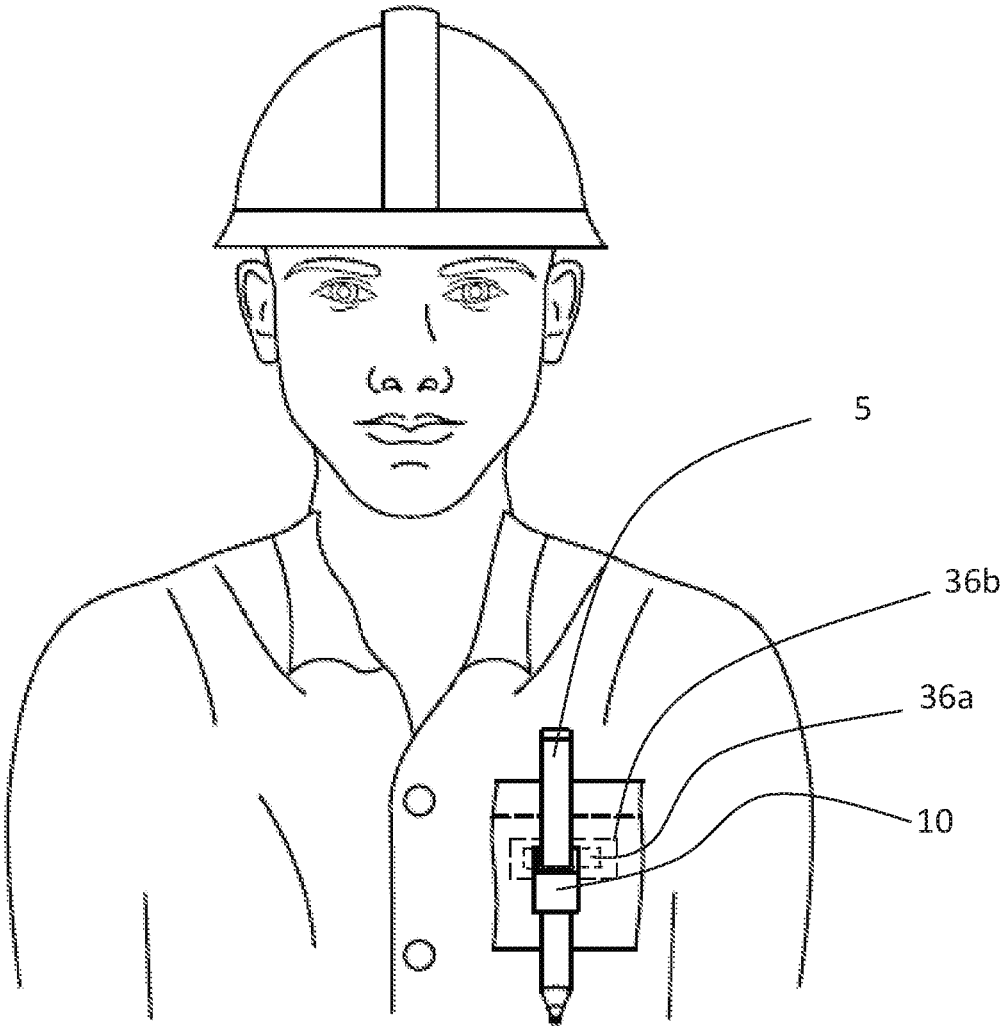
FIG. 3B, is an in-use view of an embodiment of the invention having a writing implement disposed within the pencil holder.

FIG. 3B, depicts an embodiment of an in-use view of magnetic pencil holder 10 secured to an article of clothing. First complementary magnet 36*a* is disposed of on an outside surface of an article of clothing and is magnetically attracted to second complementary magnet 36*b* disposed on an opposite side of an article of clothing. Magnet 26 of pencil holder 10 is magnetically attracted to first complementary magnet 36*a* preventing pencil holder 10 from detaching from first complementary magnet 36*a* or otherwise being misplaced. Similar to the embodiment shown in FIG. 3A and described above, when it is time for the user to use pencil holder 10 or writing implement 5 disposed within housing 12, the user can simply pull pencil holder 10 away from first complimentary magnet 36*a* so that the two are no longer in magnetic communication with one another. However, first complementary magnet 36*a* remains magnetically coupled to second complementary magnet 36*b* while pencil holder 10 is disconnected from first complementary magnet 36*a*.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A magnetic pencil holder comprising:

a housing having a body extending between a first end and a second end, the body including a plurality of lateral interior surfaces, each of the first and second ends defining an opening, with a channel extending between the plurality of lateral interior surfaces from the first end to the second end;

a protrusion disposed within the housing and extending from at least one lateral interior surface toward the channel;

a stopper disposed proximate to the second end of the body, the stopper at least partially extending from one of the lateral interior surfaces of the body toward a central longitudinal axis of the second opening; and a magnet disposed within the housing, the magnet configured to rest against at least one of the lateral interior surfaces and against the stopper, such that the stopper prevents the longitudinal movement of the magnet through the second end of the body;

wherein the housing is configured to receive a writing implement therein, such that at least one protrusion contacting the writing implement when received within the housing.

2. The magnetic pencil holder of claim 1, wherein the plurality of lateral interior surfaces further comprises a first side opposite a second side, the first side and the second side having an extension, wherein the extension extends inwardly toward the channel and contacts the writing implement, when received within the housing.

3. The magnetic pencil holder of claim 2, further comprising a slot formed adjacent to one of the plurality of lateral interior surfaces, wherein the slot is sized to receive and secure the magnet when the magnet is disposed within the housing.

4. The magnetic pencil holder of claim 1, wherein the protrusion has a length, wherein the length is equal to a length of at least one of the plurality of lateral interior surface.

5. The magnetic pencil holder of claim 1, further comprising a second protrusion having a length, wherein the length is equal to a length of at least one of the plurality of lateral interior surface.

6. The magnetic pencil holder of claim 1, wherein the body further comprises an outer surface, wherein the outer surface is configured to receive a measuring indicium.

7. The magnetic pencil holder of claim 1, further comprising a complementary magnet, wherein the magnet and the complementary magnet are magnetically attracted to one another, whereby an article of clothing is disposed between the magnet and the complementary magnet such that the magnetic pencil holder can be placed on the user for quick and easy access.

8. The magnetic pencil holder of claim 7, wherein the complementary magnet includes a fastener such that the complementary magnet is secured to an article of clothing.

9. The magnetic pencil holder of claim 1, further comprising a first complementary magnet and a second complementary magnet, wherein the first complementary magnet and the second complementary magnet are magnetically attracted to one another, whereby an article of clothing is disposed between the first and the second complementary magnets, such that the magnet of the magnetic pencil holder is magnetically attracted to either the first or the second complementary magnets securing the magnetic pencil holder on the user for quick and easy access.

10. A magnetic pencil holder comprising:

a housing having a body extending between a first end and a second end, the body including a plurality of lateral interior surfaces, each of the first and second ends defining an opening, with a channel extending between the plurality of lateral interior surfaces from the first end to the second end;

a plurality of protrusions disposed within the housing and extending from at least one lateral interior surface toward the channel;

a magnet disposed within the housing, the magnet configured to rest against at least one of the lateral interior surfaces;

wherein the housing is configured to receive a writing implement therein and the protrusion contacts the writing implement when received within the housing.

11. The magnetic pencil holder of claim 10, wherein each of the plurality of protrusions has a length, wherein the length is equal to a length of at least one of the plurality of lateral interior surface.

12. The magnetic pencil holder of claim 10, further comprising a complementary magnet, wherein the magnet and the complementary magnet are magnetically attracted to one another, whereby an article of clothing is disposed between the magnet and the complementary magnet, such that the magnetic pencil holder can be placed on the user for quick and easy access.

13. The magnetic pencil holder of claim 12, wherein the complementary magnet includes a fastener, such that the complementary magnet is secured to an article of clothing.

14. The magnetic pencil holder of claim 10, wherein the plurality of lateral interior surfaces further comprises a first side opposite a second side, the first side and the second side having an extension, wherein the extension extends inwardly toward the channel and contacts the writing implement, when received within the housing.

15. The magnetic pencil holder of claim 14, further comprising a slot formed adjacent to one of the plurality of lateral interior surfaces, wherein the slot is sized to receive and secure the magnet when the magnet is disposed within the housing.

16. A magnetic pencil holder comprising:

a housing having a body extending between a first end and a second end, the body including a plurality of lateral interior surfaces, each of the first and second ends defining an opening, with a channel extending between the plurality of lateral interior surfaces from the first end to the second end, the plurality of lateral interior surfaces further comprising a top opposite a bottom and a first side opposite a second side;

a first protrusion and a second protrusion disposed along the entire length the top lateral interior surface and extending from the top lateral interior surface the channel;

a stopper disposed proximate the second end of the body, the stopper at least partially extending from the bottom lateral interior surfaces of the body toward a central longitudinal axis of the second opening; and a magnet disposed within a first and a second slot, the first slot formed between the first side and the bottom and the second slot formed between the second side and the bottom, the magnet configured be frictionally secured when slidably inserted into the first and second slots and abutting the stopper, such that the stopper prevents the longitudinal movement of the magnet through the second end of the body, wherein the housing is configured to receive a writing implement therein and at least one of the first protrusion and the second protrusion contacts the writing implement when received within the housing.

17. The magnetic pencil holder of claim 16, wherein the first side and the second side each has an extension, wherein each extension extends inwardly toward the channel and each extension forms a portion of the first and the second slot respectively, wherein a surface of the extension contacts the writing implement, when received within the housing.

18. The magnetic pencil holder of claim 16, wherein the body further comprises an outer surface, wherein the outer surface is configured to receive a measuring indicium.

19. The magnetic pencil holder of claim 16, further comprising a complementary magnet, wherein the magnet and the complementary magnet are magnetically attracted to one another, whereby an article of clothing is disposed between the magnet and the complementary magnet, such that the magnetic pencil holder can be placed on the user for quick and easy access.

20. The magnetic pencil holder of claim 19, wherein the complementary magnet includes a fastener, such that the complementary magnet is secured to an article of clothing.

* * * * *